US005964050A

United States Patent [19]

Svahn

[11] Patent Number: 5,964,050

[45] Date of Patent: Oct. 12, 1999

[54] SCREENING DEVICE

[75] Inventor: Karl-Johan Svahn, Söråker, Sweden

[73] Assignee: Soraker Gravmaskins AB, Soraker, Sweden

[21] Appl. No.: 08/945,245

[22] PCT Filed: Apr. 22, 1996

[86] PCT No.: PCT/SE96/00523

§ 371 Date: Oct. 24, 1997

§ 102(e) Date: Oct. 24, 1997

[87] PCT Pub. No.: WO96/34153

PCT Pub. Date: Oct. 31, 1996

[30] Foreign Application Priority Data

Apr. 24, 1995 [SE] Sweden ..... 9501490

[51] Int. Cl.[6] ..... E02F 3/76; E02F 3/96

[52] U.S. Cl. ..... 37/409; 37/403; 37/410; 37/903

[58] Field of Search ..... 37/403, 405, 409, 37/410, 901, 903, 904

[56] References Cited

U.S. PATENT DOCUMENTS

| | | | |
|---|---|---|---|
| 4,858,346 | 8/1989 | Schulte | 37/184 |
| 5,241,764 | 9/1993 | Modig | 37/405 |
| 5,528,844 | 6/1996 | Ellis | 37/403 |
| 5,581,916 | 12/1996 | Hirose et al. | 37/444 |
| 5,664,348 | 9/1997 | Omann | 37/405 |
| 5,771,612 | 6/1998 | Lynch | 37/142.5 |

FOREIGN PATENT DOCUMENTS

| | | |
|---|---|---|
| 165844 | 1/1959 | Sweden . |
| 464094 | 3/1991 | Sweden . |
| 9003790 | 5/1992 | Sweden . |

*Primary Examiner*—Thomas B. Will
*Assistant Examiner*—Gary S. Hartmann
*Attorney, Agent, or Firm*—Jacobson, Price, Holman & Stern, PLLC

[57] ABSTRACT

A screening device, intended to be detachably fastened on a bucket of a digging machine, which in a suitable way includes a hydraulically operable arm, which is arranged to be detachably fastened on the bucket. The outer portion of the arm including a plate-formed member provided with two hooks, which are intended to mesh with elements on the bucket, which are shaped to these ones, and the plate-formed member being moveably arranged in relation to the arm by hinges and a hydraulic piston cylinder. The screening device is characterized by the combination of the following features: the screening device includes a frame portion and a screening device, which are articulately fastened to each other, and which can be adjusted in direction towards or from each other in a hydraulic way, the hydraulic power being taken from the digging machine; the frame portion is provided with two hooks, which are intended to be fastened onto pins, which are shaped to these ones and are arranged on the bucket for positioning of the screening device on the bucket, the frame portion being fastened by squeezing against the bucket by the plate-formed member on the outer portion of the arm of the digging machine.

3 Claims, 2 Drawing Sheets

SCREENING DEVICE

FIELD OF THE INVENTION

This invention relates to a screening device, intended to be detachably fastened on a bucket of a digging machine, which in a suitable way comprises a hydraulically operable arm, which is arranged to be detachably fastened on the bucket, the outer portion of the arm comprising a plate-formed means provided with two hooks, which are intended to mesh with means on the bucket, which are adapted to these ones, and the plate-formed means being movably arranged in relation to the arm by means of hinges and a hydraulic piston cylinder.

BACKGROUND OF THE INVENTION

Such devices are previously known, the screening means being intended to take an active position against the bucket itself, when a fine fraction of the material in the bucket shall be emptied out of this one, and an inactive position swung out from the bucket when a coarse fraction of the material shall be emptied out of the bucket.

The problem with known screening devices is that the screening means itself has a complicated fastening on the bucket, which means that the mounting and the demounting work, respectively, of the screening means onto respectively from the bucket itself becomes very extensive. This has the consequence that the owner of the digging machine as a rule must have a special bucket for a certain type of work and a combined aggregate comprising a bucket and a screening device for another type of work.

SUMMARY OF THE INVENTION

This invention intends to eliminate this problem and to provide a new type of screening device which enables a simple mounting of the same on a bucket and a demounting of the same from the bucket, respectively. This means that the owner of the digging machine in this case only needs to purchase a single bucket, which of course is a great advantage from an expenditural point of view. This has been made possible by a screening device of a kind mentioned by way of introduction, which is characterized by the combination of the following features:

The screening device comprises a frame portion and a screening means, which are articulately fastened to each other and which can be adjusted in the direction towards or from each other in a hydraulical way, the hydraulic power being taken from the digging machine;

The frame portion is provided with two hooks, which are intended to be fastened onto means, adapted to these ones and arranged on the bucket for positioning the screening device on the bucket, the frame portion being fastened by squeezing against the bucket by means of the plate-formed means on the outer portion of the arm of the digging machine.

BRIEF DESCRIPTION OF THE DRAWINGS

A preferred embodiment of the invention shall be described more closely below with reference to the accompanying drawings, where.

DETAILED DESCRIPTION OF THE PREFERRED EMBODIMENTS

Figure 4:
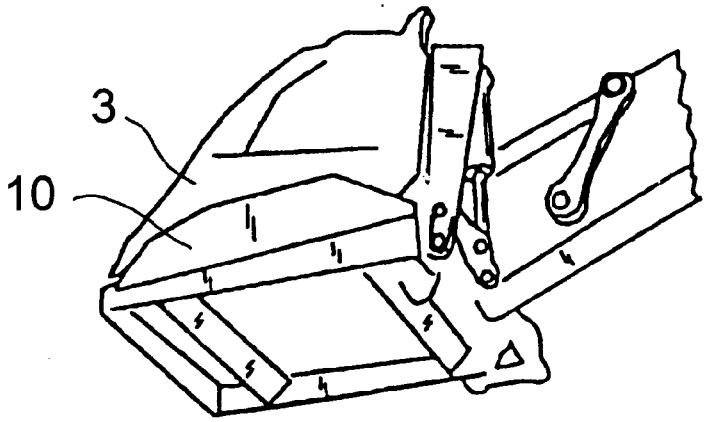
FIG. 4 shows the screening device in an active position, resting against the bucket.
Figure 5:
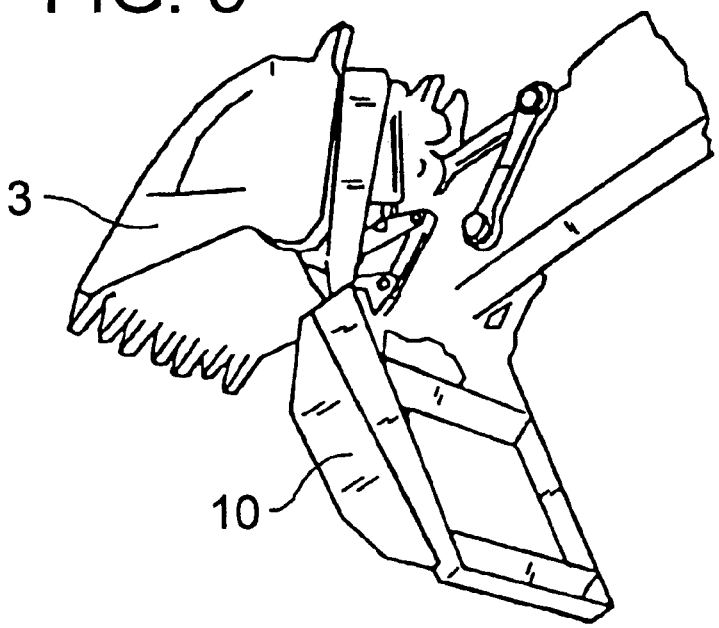
FIG. 5 shows the screening device in an inactive position, swung out from the bucket.

As is apparent from the drawings the screening device comprises a frame portion 1, which is intended to be applied to and be fastened by squeezing against an essentially planar surface portion 2 on the outside of a bucket 3 of a digging machine 4 by means of a plate-formed means 5, which is arranged at the very end of the arm 6 of the digging machine, and which is movably arranged in relation to the arm 6 by means of hinges 7, 8 and a hydraulic piston cylinder 9. The screening device further comprises a screening means 10, which in an active position is intended to be in contact with the bucket (see FIG. 4) and to carry out a screening of the material in the bucket, which can be emptied out of the same, so that only the fine fraction of the material can be emptied out, and which in an inactive position is intended to take a position, swung out, in relation to the bucket (see FIG. 5), whereby the coarse fraction of the material can be emptied out of the bucket.

The frame portion 1 and the screening means 10 are arranged to each other by means of hinges 11, 12 in such a way, that hydraulically operated piston means 13, 14 can perform the relative movements between the frame portion 1 and the screening means 10. In this connection the one end 15 of the piston means 13, 14 is fastened to the outer part of the frame portion 1, whereas the other end 16 of the piston means 13, 14 is arranged at respective hinge 11, 12.

Figure 1:
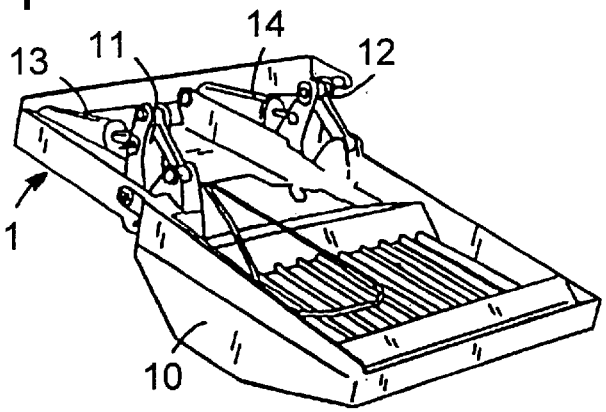
FIG. 1 shows the screening device according to the invention, separated from the bucket of the digging machine.
Figure 2:
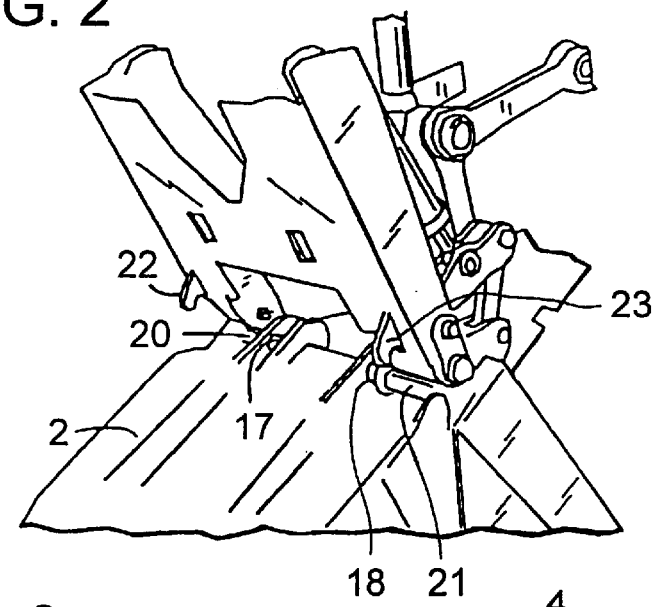
FIG. 2 shows the screening device suspended in the arm of the digging machine during the fastening to the bucket.
Figure 3:
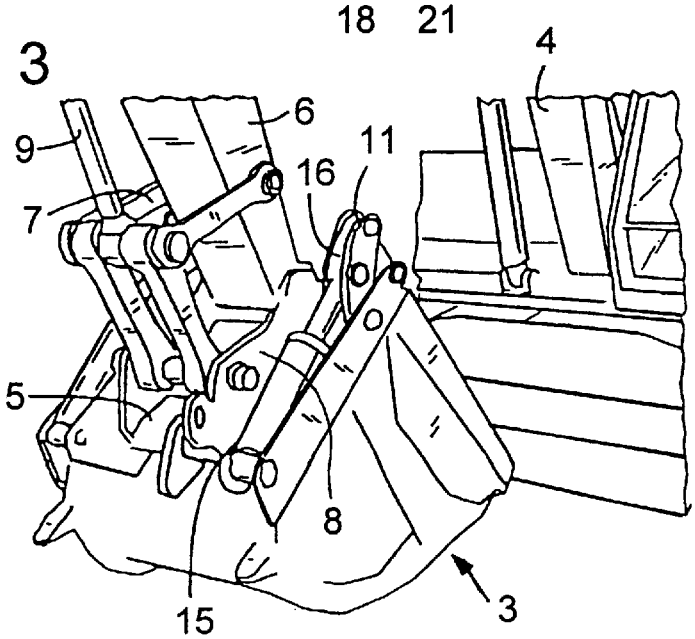
FIG. 3 shows the screening device fastened on the arm of the digging machine and the bucket, the screening device being ready to be used.

The bucket 3 in the usual way has two recesses 17, 18 at the surface portion 2, with which two strong hooks on the plate-formed means 5 of the arm 6 of the digging machine in a suitable way is intended to mesh. Furthemore, the bucket in a suitable way is provided with a hook-formed means on the surface portion 2, with which hook-formed means a projectable means on the plate-formed means 5 of the arm 6 is intended to mesh for holding the plate-formed means 5 against the surface portion 2 of the bucket. On respective outer sides of the recesses 17, 18 is welded a strong, horizontally extending, transverse pin means 20, 21, each of which is intended to cooperate with a hook-formed means 22, 23, which is arranged on the underside of the frame portion 1 for positioning this one towards the surface portion 2 of the bucket 3 (see FIG. 2).

After the hooks 22, 23 had meshed with the pin means 20, 21, the frame portion 1 is swung down by means of the piston means 13, 14 to a contact with the surface portion 2 of the bucket 3 and is locked against the same by means of the plate-formed means 5 of the arm 6 of the digging machine.

As has been mentioned previously the great advantage with this screening device according to the invention is that it has such a design that it is very simply mountable and demountable on a bucket of an existing digging machine. Thus, by purchasing the screening device according to the invention the owner of the digging machine gets an equipment, which partly enables a conventional digging with only the bucket and a digging with a screening function, the bucket being combined with the new screening device.

When mounting the screening device according to the invention the digging machine driver starts with loosening the plate-formed means 5 of the arm 6 of the digging machine from the conventional bucket, which can be performed from the driver's cab of the machine without a particular manual working effort. Thereafter, the hydraulic system of the digging machine is connected with the piston means 13, 14 of the frame portion 1 of the screening device, whereafter the screening device is lifted up by the the arm 6 of the digging machine and is placed on the surface portion 2 of the bucket 3 in such a way that the two hooks 22, 23 of the frame portion meshes with the pin-formed means 20, 21 on the surface portion 2 of the bucket. After having taken this position, the frame portion 1 is lowered down to a contact with the surface portion 2 of the bucket by means of the piston means 13, 14, whereafter the plate-formed means 5 of the arm 6 of the digging machine is brought to a contact with the bucket in a conventional way, i.e. the two hooks of the plate 5 mesh with the recesses 17, 18 of the bucket at the surface portion 2, whereafter the plate-formed means 5 is swung downwards by means of the hydraulic piston 9 for a contact against the top side of the frame portion 1, so that this portion can be fastened by squeezing against the surface portion 2 of the bucket 3. In this position the plate 5 is locked against the bucket by means of a projectable means, which meshes with the hook-formed means, existing on the surface portion 2 of the bucket 3.

This entire work except the hydraulic connection of the arm of the digging machine with the screening device can be made from the driver's cab of the digging machine, which of course results in that the work can be performed simply as well as smoothly.

When taking loose the screening device according to the invention from the bucket, the working moments are made in a reverse order and can also in this case be performed from the driver's cab of the digging machine.

The invention is of course not limited to the mentioned and described embodiment but can be modified within the scope of the following claims.

I claim:

1. A screening devices to be detachably fastened on a bucket of a digging machine, the digging machine including a hydraulically operable arm detachably fastened on the bucket, an outer portion of the arm including a plate portion provided with two hooks meshing with the bucket, and the plate portion being moveably arranged in relation to the arm by hinges and a hydraulic piston cylinder, the screening device comprising:

a frame portion and a screening portion pivotally and adjustably fastened to each other by hinges, the frame portion including two hooks for fastening the frame portion on the bucket, the frame portion being fastened on the bucket by squeezing against an outer surface portion of the bucket by the plate portion on the outer portion of the arm of the digging machine, and at least hydraulic piston cylinder connecting said frame portion and said screening portion for moving the screen portion with respect to the frame portion.

2. A device according to claim 1, wherein the frame portion has a recess in a bottom surface so that the plate portion can be locked against the bucket at the same time as the frame portion is fastened by squeezing against the surface portion of the bucket.

3. A device according to claim 1, wherein one end of the at least one hydraulic piston cylinder fastened to an outer part of the frame portion and the other end of the hydraulic piston cylinder is arranged at one of said two hinges.

* * * * *